US009518388B1

(12) United States Patent
Wang et al.

(10) Patent No.: US 9,518,388 B1
(45) Date of Patent: Dec. 13, 2016

(54) CONSTRUCTION METHOD FOR PRODUCING BEAM AND SLAB MADE OF COMPOUND CONCRETE CONTAINING DEMOLISHED CONCRETE

(71) Applicants: Guangzhou Construction Engineering Co., Ltd., Guangzhou (CN); South China University of Technology, Guangzhou (CN)

(72) Inventors: Long Wang, Guangzhou (CN); Bo Wu, Guangzhou (CN)

(73) Assignees: GUANGZHOU CONSTRUCTION ENGINEERING CO., LTD., Guangzhou (CN); SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 15/012,201

(22) Filed: Feb. 1, 2016

(30) Foreign Application Priority Data

Sep. 24, 2015 (CN) ..... 2015 1 0615235

(51) Int. Cl.
*E04B 5/32* (2006.01)
*E04B 1/16* (2006.01)
*E04C 5/06* (2006.01)

(52) U.S. Cl.
CPC ..... *E04B 5/32* (2013.01); *E04B 1/161* (2013.01); *E04C 5/0622* (2013.01); *E04C 5/0645* (2013.01); *E04B 2103/02* (2013.01)

(58) Field of Classification Search
CPC ..... E04B 5/32; E04B 1/161; E04B 2103/02; E04C 5/0622; E04C 5/0645
See application file for complete search history.

(56) References Cited

U.S. PATENT DOCUMENTS 5,317,846 A * 6/1994 Michlovic ..... E04B 5/40 52/220.2
2008/0263978 A1* 10/2008 Abou-Saleh ..... E04C 5/06 52/260

(Continued)

FOREIGN PATENT DOCUMENTS

CN 101418629 A 4/2009
CN 101671147 A 3/2010

(Continued)

*Primary Examiner* — Jeanette E Chapman
(74) *Attorney, Agent, or Firm* — Muncy, Geissler, Olds & Lowe, P.C.

(57) ABSTRACT

Construction method for producing beam and slab made of compound concrete containing demolished concrete blocks, comprises that a conventional profiled rebars are made to upper and lower L-shaped stirrups, wherein lower profiled rebar mesh are fixed up firstly, in which coarsely-crushed concrete blocks or segments are placed, then upper profiled rebar mesh are assembled on it together to form a rebar cage, and fresh concrete is poured into the mould fully. A connection portion between the upper and lower L-shaped stirrups is located around ⅓ heights of the lower L-shaped stirrup. A cold rolled rebar mesh is applied to a top rebar mesh of slab; when the bottom rebars of the slab are assembled, coarsely-crushed concrete blocks will be dosed, then the cold rolled rebar mesh will be lifted above the coarsely-crushed concrete blocks for mounting. Finally, fresh concrete is poured into the rebar cage for producing abeam and a space between top rebar mesh and bottom rebars for producing a slab.

9 Claims, 5 Drawing Sheets

(56) References Cited

U.S. PATENT DOCUMENTS

| | | | | |
|---|---|---|---|---|
| 2011/0047928 | A1* | 3/2011 | Aburto | E04B 1/161 52/745.05 |
| 2012/0047816 | A1* | 3/2012 | Zhong | E04B 1/161 52/11 |
| 2012/0233936 | A1* | 9/2012 | Zhong | E04B 1/165 52/173.1 |
| 2013/0104492 | A1* | 5/2013 | Hung | E04B 5/38 52/664 |
| 2015/0075110 | A1* | 3/2015 | Golledge | E04C 5/167 52/688 |
| 2015/0354238 | A1* | 12/2015 | Abbasi | E04G 23/0218 52/514.5 |

FOREIGN PATENT DOCUMENTS

| | | | | | |
|---|---|---|---|---|---|
| CN | 102071740 | A | * | 5/2011 | |
| CN | 102677582 | A | | 1/2013 | |
| DE | 10001839 | A1 | * | 4/2001 | E04B 5/32 |
| FR | 419620 | A | * | 1/1911 | E04B 5/32 |
| FR | 1498079 | A | * | 10/1967 | E04B 1/161 |
| KR | 100875488 | B1 | * | 12/2008 | E04B 5/32 |

* cited by examiner

CONSTRUCTION METHOD FOR PRODUCING BEAM AND SLAB MADE OF COMPOUND CONCRETE CONTAINING DEMOLISHED CONCRETE

CROSS REFERENCE TO RELATED APPLICATION

This application claims priority of Application No. 201510615235.6 filed in China on Sep. 24, 2015, under 35 U.S.C. §119, the entire contents of which are hereby incorporated by reference.

TECHNICAL FIELD

The present invention relates to a construction method, and the technical field of producing a beam/slab on site utilizing compound concrete containing demolished concrete blocks, in particular, a construction method for producing a beam/slab made of compound concrete containing demolished concrete blocks.

BACKGROUND

Compound concrete is a mixture of coarsely-crushed concrete blocks and fresh concrete. The coarsely-crushed concrete blocks come from demolished buildings, and eventually have preferred size after a series of processing, e.g. breaking, screening and purifying process. This is a new technology in response to the environmental protection requirement in the country, developing green construction industry and realizing energy saving. However, it still faces difficulties as to how to use this technology effectively in practice.

In current engineering practice, a spacing between two adjacent stirrups in beams or two adjacent rebars in slabs is typically within 300 mm, but the demolished concrete block has a large size ranging from, say, 150 to 300 mm. These coarsely-crushed demolished concrete blocks thus cannot be placed into the rebar cage, particularly in regions with congested reinforcement. Owing to this, such technology has difficulty to be further applied. Alternatively, a conventional method can be used, that is, assembling bottom rebars into a cage first, then placing coarsely-crushed concrete blocks into the cage, followed by assembling top rebars eventually to close the cage. This construction method has a long construction period onsite, costing more time and labour.

Therefore, there is a need to have a construction method for producing beam/slab made of the compound concrete, the method can utilize the demolished concrete blocks, and is more simple, fast and reliable without any impact on the reinforcement configuration and force-carrying mechanism.

THE SUMMARY OF THE INVENTION

There will be providing a construction method for producing beam/slab made of compound concrete containing demolished concrete blocks, the method is safe, flexible and effective, and solves the current problems, e.g. difficulty of placing coarsely-crushed concrete blocks into the cage and long working period.

The invention is achieved by the following solution:

A construction method for producing a beam/slab made of compound concrete containing demolished concrete blocks, the method comprises the steps of 1) a lower rebar mesh and an upper rebar mesh for producing a beam are made respectively, wherein A. steps of making the lower rebar mesh comprise placing a number of lower L-shaped stirrups at pre-specified spacing onto an open mould, wherein each lower L-shaped stirrup is somewhat of a U-shape. Two vertical segments of the lower L-shaped stirrup have different height, in which a shorter segment is roughly equal to ⅓ heights of a longer segment; and placing a number of bottom rebars at pre-specified spacing on horizontal segments of the lower L-shaped stirrups, and configuring a number of side bars at the vertical segments of the lower L-shaped stirrups wherein both the bottom rebars and the side bars are orthogonal to the lower L-shaped stirrups, and are connected to the lower L-shaped stirrups rigidly at their each intersection, thereby a latticed lower rebar mesh of the beam is formed;

B. steps of making the upper rebar mesh of beam comprise placing a number of upper L-shaped stirrups into a specific mould; and placing a number of upper rebars at pre-specified spacing on horizontal segments of the upper L-shaped stirrups, and configuring other side bars at a vertical segment of the upper L-shaped stirrups, wherein both the upper rebars and the other side bars are orthogonal to the upper L-shaped stirrups, and are connected to the upper L-shaped stirrups rigidly at their each intersection, thereby a latticed upper rebar mesh of the beam is formed;

2) placing coarsely-crushed concrete blocks or segments into the lower rebar mesh, then configuring the upper rebar mesh above the lower rebar mesh, the upper rebar mesh is connected to the lower rebar mesh through a threaded sleeve, whereby a beam rebar cage is formed; when fresh concrete has been poured into the beam rebar cage fully, a construction of the beam made of compound concrete containing demolished concrete blocks is completed.

According to the construction method for producing a beam/slab made of compound concrete containing demolished concrete blocks, in the step 1), the lower and upper rebar meshes of beam are manufactured respectively, and in the step 2), a connection portion among the lower rebar mesh and the upper rebar mesh is located at a top end of the vertical shorter segment of the lower L-shaped stirrup, after placing the coarsely-crushed concrete blocks or segment into the lower rebar mesh, the upper rebar mesh is lifted above the lower rebar mesh.

According to the construction method for producing a beam/slab made of compound concrete containing demolished concrete blocks, screw threads are configured on ends of vertical segments of the upper L-shaped stirrups and top ends of vertical shorter segment of the lower L-shaped stirrups respectively.

According to the construction method for producing a beam/slab made of compound concrete containing demolished concrete blocks, a threaded sleeve is screwed into the screw thread of each lower L-shaped stirrup, length of the screw thread of each upper L-shaped stirrup is twice a length of the threaded sleeve, and the lower L-shaped stirrups and the upper L-shaped stirrups are connected to each other by the threaded sleeves.

According to the construction method for producing a beam/slab made of compound concrete containing demolished concrete blocks, a length of the screw thread of each lower L-shaped stirrup is equal to or slightly larger than the length of the threaded sleeve.

According to the construction method for producing a beam/slab made of compound concrete containing demolished concrete blocks, an internal diameter of the threaded sleeve is equal to a diameter of the stirrups, preferably a reference diameter of an internal thread of the threaded sleeve is 10 mm.

According to the construction method for producing a beam/slab made of compound concrete containing demolished concrete blocks, in the step 2), when the lower rebar mesh of the beam is formed and placed into an open mould, placing the coarsely-crushed concrete blocks or segments into the lower rebar mesh, then the upper rebar mesh is lifted above the lower rebar mesh, and connected to the lower rebar mesh by threaded sleeves, and fresh concrete is poured into the beam rebar cage until full.

According to the construction method for producing a beam/slab made of compound concrete containing demolished concrete blocks, it further comprises steps of fixing bottom rebars of a slab onto the beam rebar cage, placing coarsely-crushed concrete blocks onto the bottom rebars of the slab, then lifting a top rebar mesh of the slab, made of a cold rolled rebar mesh, above the coarsely-crushed concrete blocks, and assembling the bottom rebars and the top rebar mesh of the slab together.

According to the construction method for producing a beam/slab made of compound concrete containing demolished concrete blocks, the cold rolled rebar mesh can be prefabricated based on a relevant blueprint.

By the abovementioned solution, the following benefits of the present invention can be achieved:

1) the construction is convenient, fast, safe for operation, cost-effective, and thus contributes to widespread use of demolished concrete as well as concrete-encased composite beams in the engineering application;
2) the construction is simple to easy-to-implement, and has a relative short duration, which can save electricity and has no constraint imposed by the weld ability of the rebars;
3) the construction is safe and has no risk of fire, is not limited by weather condition, and is free of noise;
4) compared to the connection of the conventional straight thread, this method eliminates the need of rotating the upper rebars and is not limited by the rotational position thereof, which saves manual operation during connection and thus promote the construction progress;
5) the construction improves the efficiency and eliminates cumbersome processes, such as straightening, cutting, positioning and assembling the rebars on site, which largely shortens the work duration.

DETAILED EMBODIMENT OF THE INVENTION

Figure 1:
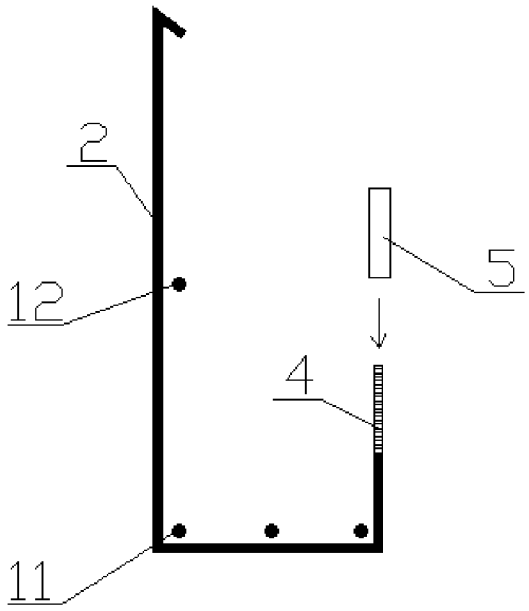
FIG. 1 shows a schematic view of lower L-shaped profiled stirrup of a beam according to the invention.

The invention will be described hereinafter with reference to two embodiments and figures, however those do not constitute any limitation to the invention.

LIST OF REFERENCE CHARACTERS AND FIGURES

In these embodiments, a dimension of a beam is 300 mm×700 mm, a thickness of a slab is 200 mm, wherein

13 depicts three upper rebars of the beam made of class-3 steel having a diameter of 25 mm;

12 depicts two side bars of the beam made of class-2 steel having a diameter of 12 mm;

11 depicts three bottom rebars of the beam made of class-3 steel having a diameter of 25 mm;

1 and 2 depict stirrups made of class-1 steel having a diameter of 8 mm, and an interval between two adjacent stirrups is 100-200 mm; and

7 and 8 depict rebars of slab made of class-1 steel having a diameter of 10 mm.

Embodiment

With reference to FIG. 1-7, a construction method for producing a beam and slab made of compound concrete containing demolished concrete blocks, is as follows:

In order to produce a beam, a lower rebar mesh and an upper rebar mesh should be made, wherein steps of making the lower rebar mesh of the beam comprise:

placing a number of lower L-shaped stirrups 2 at pre-specified spacing into an open mould 10, wherein each lower L-shaped stirrup 2 is U-shaped substantially, two vertical segments have a different height, in which a shorter segment is roughly equal to ⅓ heights of a longer one; and placing a number of bottom rebars 11 at pre-specified spacing on horizontal segments of the lower L-shaped stirrups 2, and configuring a number of side bars 12 at the vertical segments of the lower L-shaped stirrups 2, wherein both of the bottom rebars 11 and the waist rebar 12 are orthogonal to the lower L-shaped stirrups 2, and are connected to the lower L-shaped stirrups 2 rigidly at their each intersection, thereby a latticed lower rebar mesh of the beam is formed;

steps of making the upper rebar mesh of the beam comprise:

placing a number of upper L-shaped stirrups 1 onto a specific mould; and placing a number of upper rebars 13 at pre-specified spacing on horizontal segments of the upper L-shaped stirrups 1, configuring other side bars 12' at a vertical segment of the upper L-shaped stirrups 1, wherein each upper rebar 13/waist rebar 12' is orthogonal to the upper L-shaped stirrups 1, and is connected to the upper L-shaped stirrups 1 rigidly at their each intersection, thereby a latticed upper rebar mesh of the beam is formed.

Placing the lower rebar mesh of the beam into the open mould 10, then placing the coarsely-crushed concrete blocks 9 or segment 9Q into the lower rebar mesh, and configuring the upper rebar mesh of the beam above the lower rebar mesh of the beam, whereby a beam rebar cage is formed. When fresh concrete has been poured into the beam rebar cage fully, a construction of the beam made of compound concrete containing demolished concrete blocks is completed.

A connection portion among the upper L-shaped stirrup 1 and the lower L-shaped stirrup 2 is located at a top end of the vertical shorter segment of the lower L-shaped stirrup 2, wherein screw threads 3, 4 are provided on their connection ends of both stirrup 1 & 2 respectively, whereby the upper L-shaped stirrup 1 can be connected to the lower L-shaped stirrup 2 by a threaded sleeve 5 screwing both the screw threads 3 & 4 together, preferably the threaded sleeve 5 can be screwed on the screw thread 4, being ready for screwing the screw thread 3 when both stirrups 1 & 2 need to be joined together.

Length of the screw threads 3 can be ½ length of the threaded sleeve 5, and length of the screw thread 4 can be equal to or slightly greater than length of the threaded sleeve 5. An internal diameter of the threaded sleeve 5 is equal to a diameter of both the stirrups 1 & 2, preferably a reference diameter of an internal thread of the threaded sleeve 5 is 10 mm in this embodiment.

Furthermore, a cold rolled rebar mesh is applied to a top rebar mesh of the slab, and will be lifted over the open mould 10 for mounting. The cold rolled rebar mesh may be prefabricated based on a relevant blueprint.

After the beam rebar cage was formed and fresh concrete has been poured into the beam rebar cage fully, the bottom rebars 7 of the slab is positioned onto the mould 10, then the coarsely-crushed concrete blocks 9 are placed on the bottom rebars 7 of the slab, and the cold rolled rebar mesh, i.e. the top rebar mesh of the slab, is lifted over the open mould 10 for mounting.

Figure 2:
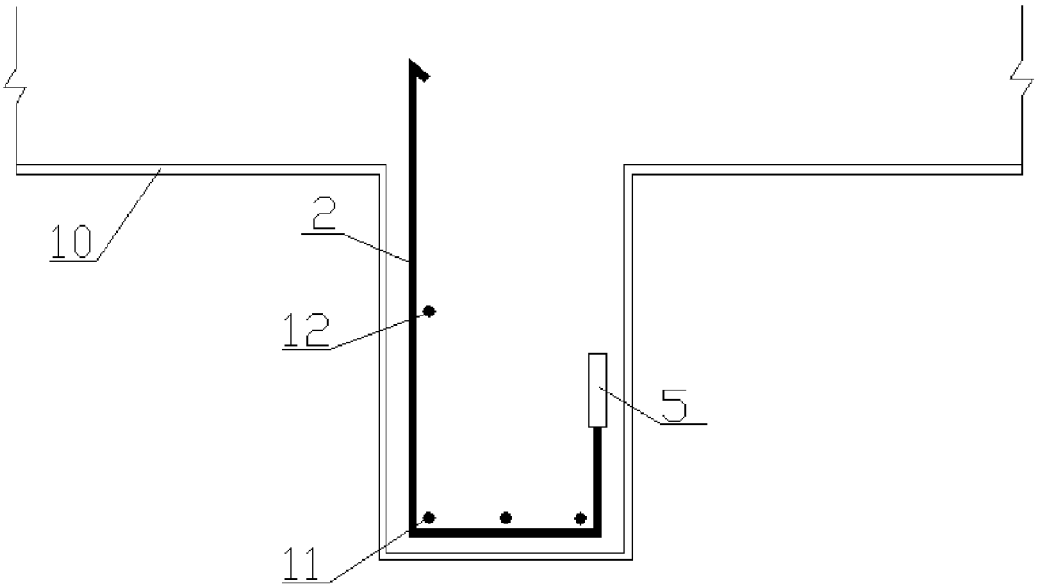
FIG. 2 shows a schematic view of a lower L-shaped profiled stirrup of the beam in mould according to the invention.
Figure 3:
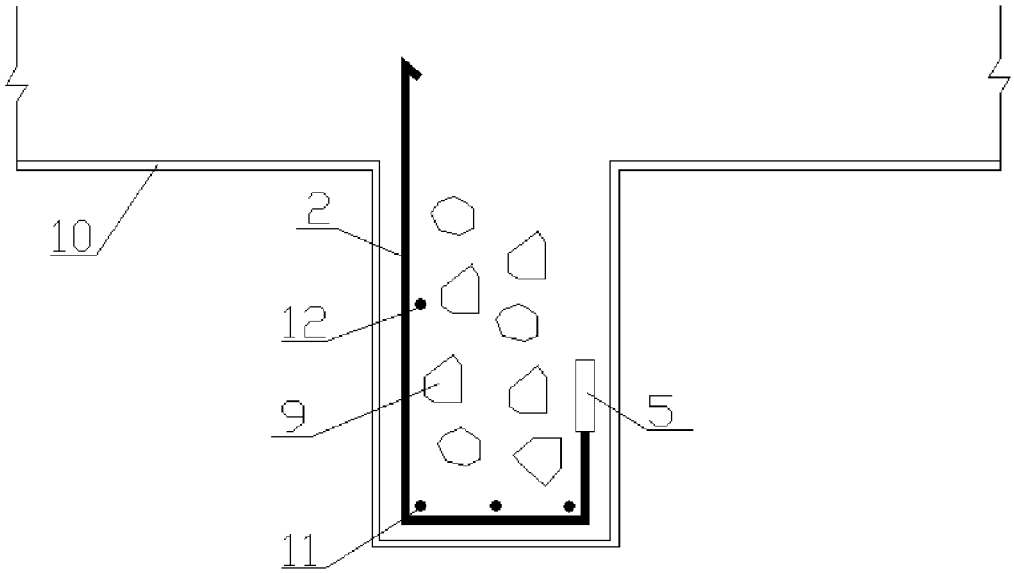
FIG. 3 shows a schematic view when the coarsely-crushed concrete blocks were arranged within the profiled stirrup in FIG. 2 according to the invention.
Figures 4A, 4B, 4C:
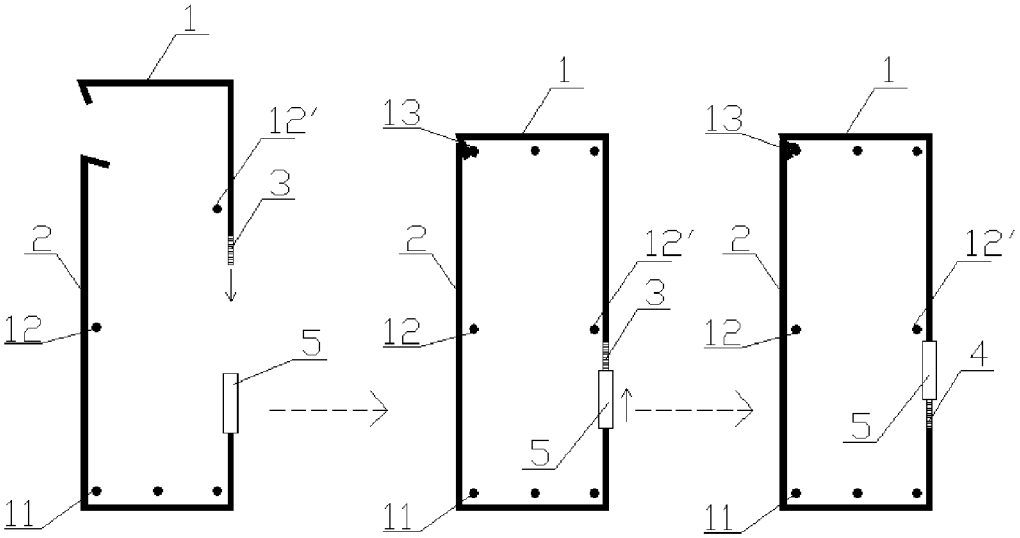
FIGS. 4*a*, 4*b* and 4*c* show schematic views to install upper L-shaped stirrup and upper rebars of the beam according to the invention.
Figure 5:
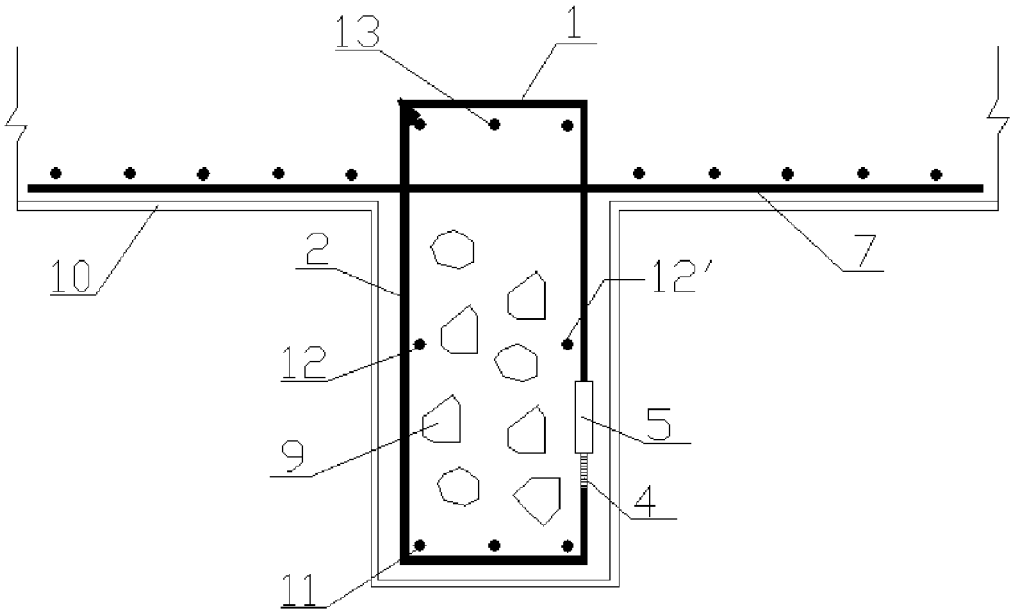
FIG. 5 shows a schematic view of installing a bottom of a slab according to the invention.
Figure 6:
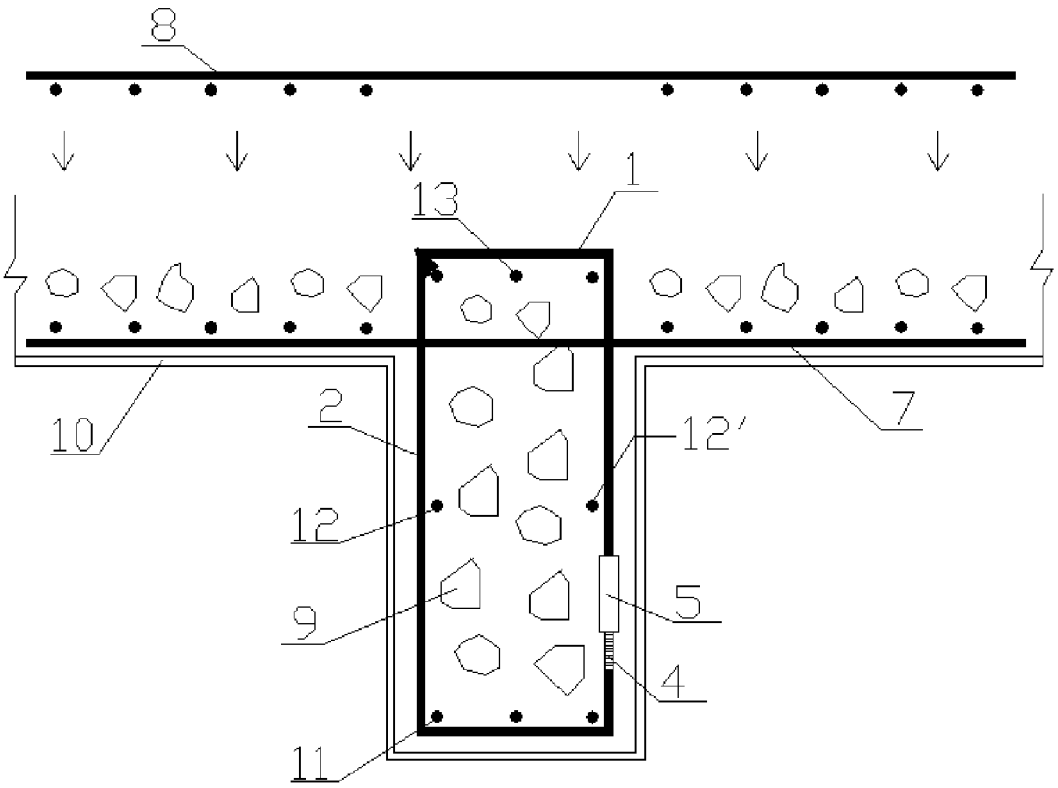
FIG. 6 shows a schematic view of placing the coarsely-crushed concrete blocks in the bottom of the slab and installing upper rebars of the slab according to the invention.
Figure 7:
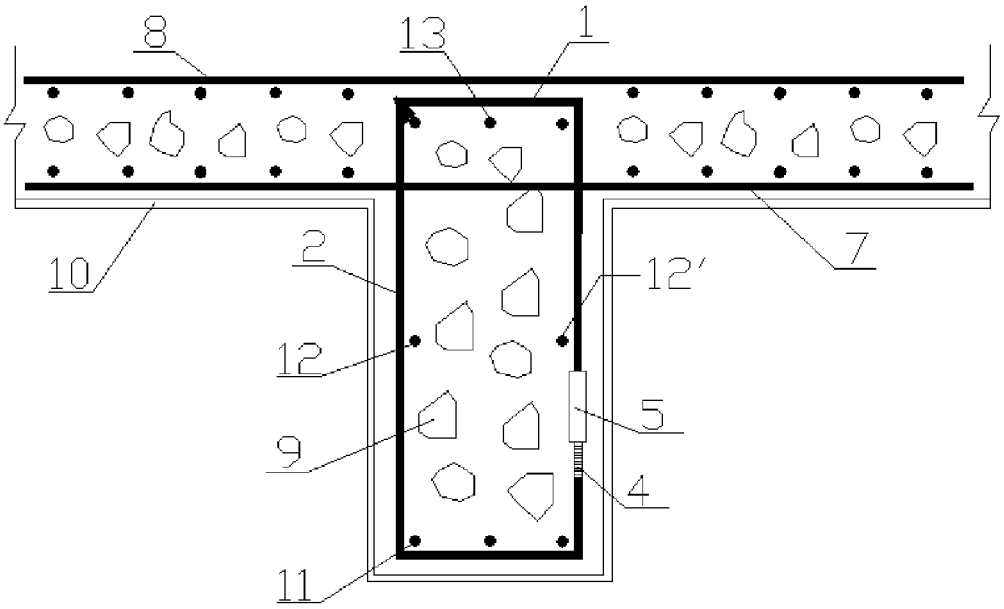
FIG. 7 shows a schematic view of a finished profiled beam and slab made from the mixture of coarsely-crushed concrete blocks and fresh concrete according to the invention.
Figure 8:
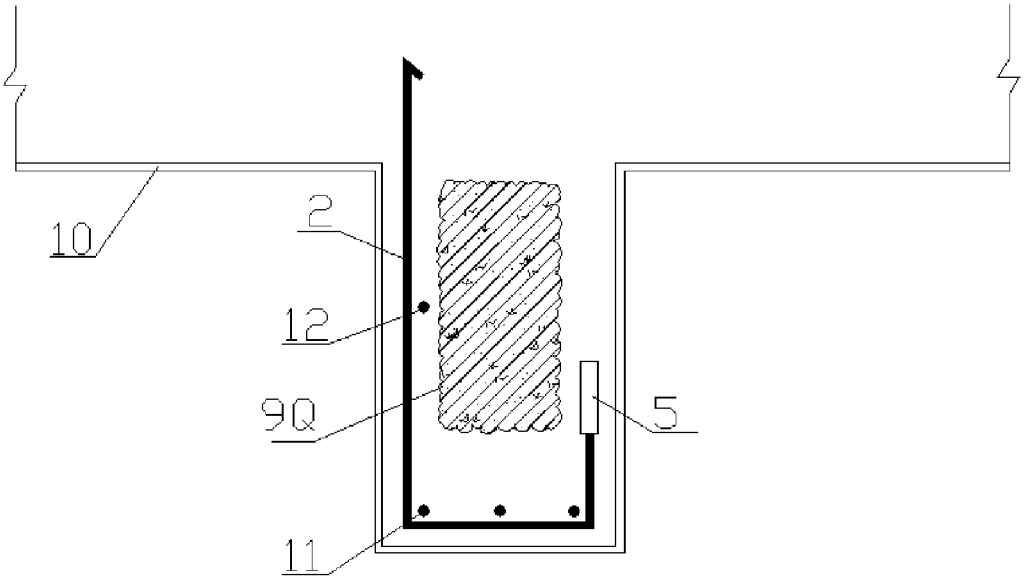
FIG. 8 shows a schematic view when the coarsely-crushed concrete segment was arranged within the profiled stirrup in FIG. 2 according to the invention.

During the construction, the process steps are as follows:

1) Prefabricating an upper L-shaped stirrup 1 and a lower L-shaped stirrup 2 in moulds, then lifting the bottom rebars 11 and the waist rebar 12 at pre-specified spacing, on horizontal segments and at vertical segments respectively, of the lower L-shaped stirrups 2, and fixing them together rigidly at their each intersection, thereby a latticed lower rebar mesh of the beam is formed; lifting the upper rebars 13 and other side bars 12' at pre-specified spacing, at horizontal segments and at vertical segments respectively, of the upper L-shaped stirrups 1, and fixing them together rigidly at their each intersection, thereby a latticed upper rebar mesh of the beam is formed; a threaded sleeve 5 can be screwed on a screw thread 4 located at an end of the vertical shorter segment of each lower L-shaped stirrup 2, as shown in FIG. 1;
2) placing the lower rebar mesh of the beam into the open mould 10, as shown in FIG. 2;
3) placing/arranging coarsely-crushed concrete blocks 9 or segment 9Q into the lower rebar mesh of the beam, as shown in FIGS. 3 & 8;
4) aligning the upper L-shaped stirrups 1 with the lower L-shaped stirrups 2, that is, a head of the upper L-shaped stirrups 1, i.e. a screw thread 3, is aligned to a head of the lower L-shaped stirrups 2, i.e. a screw thread 4, then screwing the threaded sleeve 5 onto the screw threads 3 & 4 together, whereby a beam rebar cage is formed;
5) fixing a bottom rebars 7 of a slab to the beam rebar cage rigidly, as shown in FIG. 5;
6) placing the coarsely-crushed concrete blocks 9 onto the bottom rebars 7 of the slab, and lifting a cold rolled rebar mesh over the coarsely-crushed concrete blocks 9 for mounting, as shown in FIG. 6; and
7) pouring fresh concrete to the beam rebar cage and the space between the rebars 7 and 8, whereby the construction for producing a beam and slab is completed, as shown in FIG. 7.

Please understand that the embodiments described hereinbefore are merely preferred embodiments of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A construction method for producing a beam and slab made of compound concrete containing demolished concrete blocks, the method comprises the steps of 1) a lower rebar mesh and an upper rebar mesh for producing a beam are made respectively, wherein A. steps of making the lower rebar mesh comprise placing a number of lower L-shaped stirrups at pre-specified spacing onto a open mould, wherein each lower L-shaped stirrup is U-shaped substantially, two vertical segments have a different height, in which a shorter segment is roughly equal to ⅓ heights of a longer segment; and placing a number of bottom rebars at pre-specified spacing on horizontal segments of the lower L-shaped stirrups, and configuring a number of side bars at the vertical segments of the lower L-shaped stirrups, wherein both the bottom rebars and the side bars are orthogonal to the lower L-shaped stirrups, and are connected to the lower L-shaped stirrups rigidly at their each intersection, thereby a latticed lower rebar mesh of the beam is formed;

B. steps of making the upper rebar mesh of beam comprise placing a number of upper L-shaped stirrups onto a specific mould; and placing a number of upper rebars at pre-specified spacing on horizontal segments of the upper L-shaped stirrups, and configuring other side bars at a vertical segment of the upper L-shaped stirrups, wherein both the upper rebars and the other side bars are orthogonal to the upper L-shaped stirrups, and are connected to the upper L-shaped stirrups rigidly at their each intersection, thereby a latticed upper rebar mesh of the beam is thus formed;

2) placing coarsely-crushed concrete blocks or segments into the lower rebar mesh, then configuring the upper rebar mesh above the lower rebar mesh, the upper rebar mesh is connected to the lower rebar mesh through a threaded sleeve, whereby a beam rebar cage is formed; when fresh concrete has been poured into the beam rebar cage fully, a construction of the beam made of compound concrete containing demolished concrete blocks is completed.

2. The construction method of claim 1, wherein in the step 1), the lower and upper rebar meshes of beam are manufactured respectively, and in the step 2), a connection portion among the lower rebar mesh and the upper rebar mesh is located at a top end of the vertical shorter segment of the lower L-shaped stirrup, after placing the coarsely-crushed concrete blocks 9 or segment 9Q into the lower rebar mesh, the upper rebar mesh is lifted above the lower rebar mesh.

3. The construction method of claim 2, wherein screw threads are configured on ends of vertical segments of the upper L-shaped stirrups and top ends of vertical shorter segment of the lower L-shaped stirrups respectively.

4. The construction method of claim 3, wherein a threaded sleeve is screwed into the screw thread of each lower L-shaped stirrup, length of the screw thread of each upper L-shaped stirrup is twice a length of the threaded sleeve, and the lower L-shaped stirrups and the upper L-shaped stirrups are connected to each other by the threaded sleeves.

5. The construction method of claim 4, wherein a length of the screw thread of each lower L-shaped stirrup is equal to or slightly larger than the length of the threaded sleeve.

6. The construction method of claim 5, wherein an internal diameter of the threaded sleeve is equal to a diameter of the stirrups, preferably a reference diameter of an internal thread of the threaded sleeve is 10 mm.

7. The construction method of claim 4, wherein in the step 2), when the lower rebar mesh of the beam is formed and placed into an open mould, placing the coarsely-crushed concrete blocks or segments into the lower rebar mesh, then the upper rebar mesh is lifted above the lower rebar mesh, and connected to the lower rebar mesh by threaded sleeves, and fresh concrete is poured into the beam rebar cage fully.

8. The construction method of claim 1, further comprising steps of fixing bottom rebars of a slab onto the beam rebar cage, placing coarsely-crushed concrete blocks onto the bottom rebars of the slab, then lifting a top rebar mesh of the slab, made of a cold rolled rebar mesh, above the coarsely-crushed concrete blocks, and assembling the bottom rebars and the top rebar mesh of the slab together.

9. The construction method of claim 8, wherein the cold rolled rebar mesh can be prefabricated based on a relevant blueprint.

* * * * *